US007204058B2

(12) United States Patent
Long

(10) Patent No.: US 7,204,058 B2
(45) Date of Patent: Apr. 17, 2007

(54) CONCRETE ARCH AND METHOD OF MANUFACTURE

(75) Inventor: Adrian Ernest Long, Belfast (GB)

(73) Assignee: The Queen's University of Belfast, Belfast, Northern Ireland (GB)

( * ) Notice: Subject to any disclaimer, the term of this patent is extended or adjusted under 35 U.S.C. 154(b) by 0 days.

(21) Appl. No.: 11/127,624

(22) Filed: May 12, 2005

(65) Prior Publication Data

US 2005/0229502 A1 Oct. 20, 2005

Related U.S. Application Data

(63) Continuation of application No. PCT/GB03/04878, filed on Nov. 12, 2003.

(30) Foreign Application Priority Data

Nov. 13, 2002 (GB) ..... 0226439.8

(51) Int. Cl.
*E01D 21/00* (2006.01)
*E04C 3/44* (2006.01)
*E04B 1/32* (2006.01)

(52) U.S. Cl. ..... 52/89; 14/24; 110/331

(58) Field of Classification Search ..... 52/86, 52/89, 329, 125.1–125.4; 14/24–26; 110/331, 110/335

See application file for complete search history.

(56) References Cited

U.S. PATENT DOCUMENTS 403,152 A * 5/1889 Sleicher ..... 110/335
918,366 A * 4/1909 Quereau ..... 52/98
1,230,441 A * 6/1917 Stvens ..... 248/228.5
2,826,157 A * 3/1958 Vartia ..... 52/745.08
2,874,812 A * 2/1959 Clevett, Jr. ..... 52/223.7
3,005,422 A * 10/1961 Heuer ..... 110/335
3,093,099 A * 6/1963 Grigsby ..... 110/331
3,104,631 A * 9/1963 Copeland ..... 110/335
3,340,832 A * 9/1967 Grigsby ..... 110/331
3,346,248 A * 10/1967 Martinet et al. ..... 432/119
3,568,611 A * 3/1971 Konrad et al. ..... 110/335
3,624,733 A * 11/1971 Eadie et al. ..... 110/335
3,756,172 A * 9/1973 Brereton et al. ..... 110/335
3,788,015 A * 1/1974 Musser ..... 52/81.1
4,226,061 A * 10/1980 Day, Jr. ..... 52/125.2
4,601,079 A * 7/1986 Corica ..... 14/2.4
5,644,893 A * 7/1997 Neighbours ..... 52/745.19
6,877,283 B2 * 4/2005 Yoshiwara et al. ..... 52/89

(Continued)

FOREIGN PATENT DOCUMENTS

EP 1 213 396 A8 7/2002

(Continued)

*Primary Examiner*—Robert Canfield
(74) *Attorney, Agent, or Firm*—Akin Gump Strauss Hauer & Feld, LLP

(57) ABSTRACT

A flat-formed arch ring unit includes a linear array of voussoir portions connected along their upper edges. The unit is then archable. A method is provided for forming an archway including the steps of arching one or more the flat formed arch ring units and locating them between two or more foundation blocks or the like. This provides a simple yet effective process and unit for forming an archway. With ease of production, shaping and transportation, making new archways or carrying out repairs of existing bridge archways is significantly faster and cheaper, minimizing disruption and delay to traffic.

15 Claims, 5 Drawing Sheets

U.S. PATENT DOCUMENTS

| | | | | |
|---|---|---|---|---|
| 6,988,337 | B1 * | 1/2006 | Heierli | 52/86 |
| 2003/0159370 | A1 * | 8/2003 | Drew | 52/89 |

FOREIGN PATENT DOCUMENTS

| | | | |
|---|---|---|---|
| GB | 2 266 740 | A | 11/1993 |
| GB | 2 277 344 | A | 10/1994 |
| JP | WO 99/25933 | A1 | 5/1999 |
| WO | WO 94/12728 | A1 | 6/1994 |

* cited by examiner

CONCRETE ARCH AND METHOD OF MANUFACTURE

CROSS-REFERENCE TO RELATED APPLICATIONS

This application is a continuation of International Application No. PCT/GB2003/004878, filed Nov. 12, 2003, which was published in the English language on May 27, 2004, under International Publication No. WO 2004/044332 A1 and the disclosure of which is incorporated herein by reference.

BACKGROUND OF THE INVENTION

The present invention relates to a new arch ring unit and a method of using the arch ring unit to form new archways particularly but not exclusively for road, rail etc. arches and bridges.

In Northern Ireland alone there are approximately 4,500 bridges having a span of over two meters. Of these approximately 3,500 are masonry arches. Many of these masonry arches are old and indeed historic, but nevertheless must be maintained to a high standard in order to continue to carry traffic. Indeed, in order to continue to carry increasingly large volumes of traffic.

The maintenance of masonry arches is an annual exercise, requiring significant funding and staff time. Complete rebuilding of masonry arches involves complete closure of the relevant intersection, i.e. at least one or two road and rail passageways. Repair is therefore preferred. Extrapolation of the above statistics and considerations to the whole of the British Isles, and indeed beyond, shows the enormity of work involved every year by local road maintenance workers.

One method of strengthening existing masonry arches is to strengthen the arch barrel by guniting. This has important environmental considerations, and for the replacement of masonry arches of modest span, the use of concrete pipes is preferred, and is the most economical method. However, standard concrete pipes have a maximum span of 2 meters. For each different span greater than 2 meters, a different pre-cast mold is required. Moreover, the transportation of concrete arches, having a span of at least two meters, and frequently significantly more, is a major exercise in its own right. Transportation often involves significant traffic considerations, i.e. a large, slow load.

Thus, any significant reduction in repair time, staff times and transportation considerations, would provide significant benefit. Indeed, for the repair and strengthening of many archways, the very high costs of service diversion and replacement often exceeds the cost of the bridge works themselves.

BRIEF SUMMARY OF THE INVENTION

It is an object of the present invention to provide a better method of forming archways.

Thus, according to one aspect of the present invention, there is provided a flat-formed arch ring unit comprising a linear array of voussoir portions connected along their upper edges.

The arch ring unit could be formed by any suitable method of manufacture. Preferably, the ring unit is cast.

The arch ring unit of the present invention could be formed of any suitable material or combination of materials suitable for building an arch. Generally, the ring unit is formed wholly or substantially of concrete. Different types and mixes of concrete to provide different strengths or other functions are well known in the art. A standard building concrete is generally 30 or 40 N/mm$^2$.

According to one embodiment of the present invention, the arch ring unit includes one or more lifting points along its length. Preferably, the arch ring unit is liftable and transportable in its linear shape, thereby significantly increasing ease of transportation of the arch ring to its site of use.

The arch ring unit could include one or more lifting hooks at the or each lifting point. Where more than one hook is used, the hooks are preferably aligned. More preferably, there is at least one hook per voussoir. More preferably, all the hooks are liftable using a single bar or rod, to help maintain alignment of the voussoirs during lifting. Hooks at an angle, such as about 45°, to the plane of the ring unit also provide locations for cross-supporting bars when a number of the ring units are located in an aligned series in use.

According to another embodiment of the present invention, the arch ring unit includes reinforcement within the ring unit, preferably wholly or substantially within the area of connection of the voussoir portions. Preferably, the ring unit has a continuous band of material along the top of, or as part of, the upper edges of the voussoir portions. More preferably, this band of material includes a length, strip, band or similar reinforcement to assist in holding the voussoir portions together. Reinforcement for concrete in building materials is well known in the art, and includes lattices. Preferably the lattice is a plastic grid, having some degree of flexibility.

The reinforcement may be exposed to the atmosphere during bending of the arch ring unit to form an archway as described below. Preferably therefore, the reinforcement is an inert non-corrosive material, which has sufficient strength to connect the voussoir portions during handling and transportation until placed in a permanent position on site.

In another embodiment of the present invention, the band, etc of material along the top of the arch ring unit has a different material makeup to that of the remaining part of the arch ring unit. Preferably, the upper band layer includes a layer of fiber reinforced concrete, more preferably within which is located the reinforcement. One such fiber is polypropylene fiber, which can be added at a rate of, for example, about 0.9 kg/cu m.

Each or some of the voussoir portions could be formed with corresponding male and female parts on their sides, which parts come together and form a shear key or similar, once the arch unit is formed. This improves the alignment and strength of the voussoir portions.

The arch ring unit of the present invention is preferably formed by casting. In one embodiment of the present invention, the ring unit is cast in a shaped mold or former. To form the voussoir portions, generally wedge-shaped portions are required to extend upwardly at regular intervals along the linear array during the arch ring forming process. Such wedge portions could be integral with the ring unit former, and/or movable to provide different shaped voussoir portions. More preferably, the wedges are separable from the ring unit former, such that there is full flexibility in the number, shape and design of the voussoir portions within the ring unit former, generally a mold.

The wedge portions must be strong and sufficiently robust to withstand the pouring of the unit material, generally concrete. They must also be easily removable after forming and curing of the ring unit. A featheredge on the wedge portion or similar is preferable for the accurate formation of the voussoir joints.

According to a second aspect of the present invention, there is provided a process for forming a flat-formed arch ring unit as hereinbefore described, comprising the steps of:

separately forming each voussoir portion;

aligning the voussoir portions such that their wider top faces wholly or substantially meet; and forming a connection layer across the top of the voussoir portions.

This process allows each voussoir portion to be formed separately. This is a simple process, the former or mold for which is a simple trapizoidal shape. After forming the voussiors, they can be easily aligned and the separate connection layer easily formed thereacross. The connection layer could be formed with the addition of the reinforcement and/or lifter and points hereinbefore described.

This two-stage casting provides simple casting steps, and avoids the need for complicated mold shapes. Spacers or similar, such as the wedge portions as hereinbefore defined, could be used to support the inter-voussoir gaps in the flat unit shape during lifting and transportation.

The process of the present invention is preferably a flat casting process. Flat forming or casting is significantly easier as is known in the art compared with curved or arched casting.

According to a third aspect of the present invention, there is provided a method of forming an archway comprising arching of a flat formed arch ring unit as hereinbefore described, and location of one or more arched ring units between two or more foundation blocks or the like.

The method of the present invention is equally applicable to forming a new archway, or for reinforcement and/or replacement of an existing archway.

The present invention is suitable for forming archways having any suitable span. The span of archways for most bridges is mostly in the range about three to eight meters.

In one embodiment of the present invention, the archway is formed underneath an existing archway, and the resulting inter-archway gap is filled with support materials. Such a system minimis disruption to traffic and services, and also preserves the existing aesthetics of the structure.

According to an alternative embodiment, a new archway is formed. Such an archway could be lowered into place to form a permanent framework which could then be used to cast any additional structural element and reinforcement required, and which could act compositely with the pre-cast unit. If the archway formed were to be the only structural element, then only fill would be required to be placed on top.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
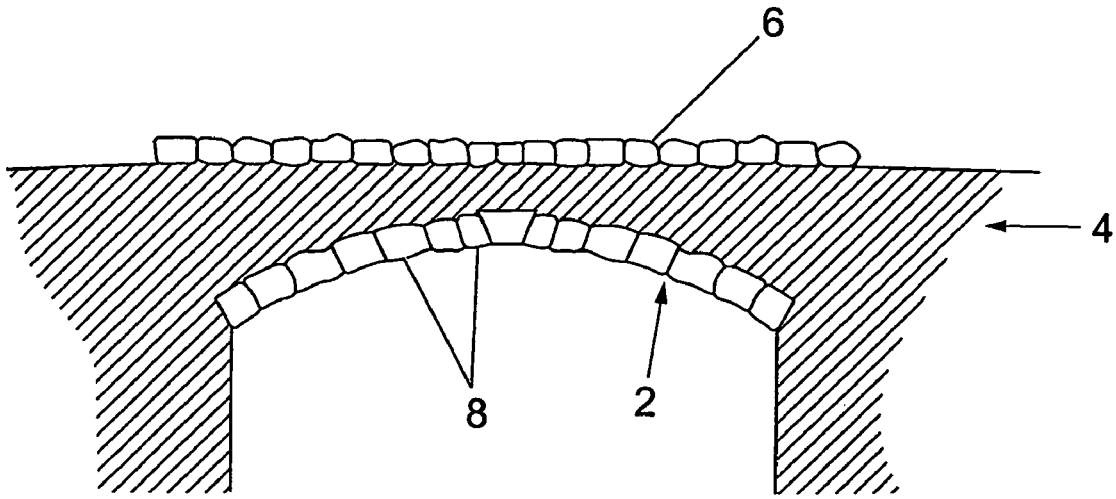
Fig. 1 PRIOR ART
FIG. 1 is a side profile of an existing arch, spandrel and parapet.

Referring to the drawings, FIG. 1 shows an existing arch 2, spandrel 4, and parapet 6. Such arches 2 are made up of a number of discrete units called voussoirs 8, each of which is shaped specifically to give the arched profile. New masonry arches have not been built for many years because of the labor intensive cost of building and setting up the necessary framework, and the cutting of masonry to form the arch barrel.

One prior method of repairing the arch of FIG. 1 is to insert a pre-formed concrete archway of the right dimensions. However, each archway must be adapted to fit the shape of the arch, and the transportation of such concrete archways is a significant exercise, especially where the span could be eight meters.

Figure 2:
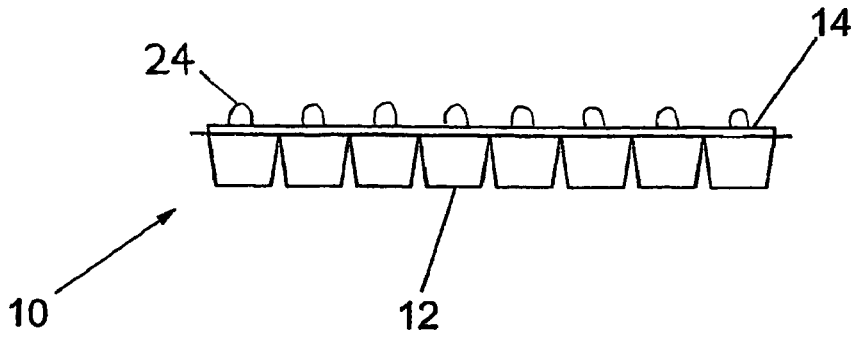
FIG. 2 is a side view of an arch ring unit according to the present invention.

FIG. 2 shows an arch ring unit 10 of the present invention. The arch ring unit 10 comprises a linear array of a number of connected voussoir portions 12 connected along their upper edges 14. These upper edges 14 will form the extrados of the arch in due course. The arch ring unit 10 is shown in more detail in FIG. 6.

Each unit 10 could be about 400 mm wide and about 200 mm high, and weigh about 1 ton. Eight such units 10 together would form an arch about 3.2 m wide. A 5000 mm length of unit 10 would provide an approximate span of about 4 m and a rise of about 1 m.

The ring unit 10 is cast in flat form. Casting in flat form is well known in the art. It is a relatively simple exercise, and the dimensions of the cast can be easily changed as desired. Moreover, casting concrete in flat form ensures correct cast location and curing as known in the art.

Preferably, the arch ring unit 10 is formed by a two-part casting process, wherein each voussior portion 12 is formed separately and then brought together. A separate connection layer 22 is then cast across the tops of the voussoir portions with the reinforcing grid laid therein. Lifting hooks 24, for example 24:5-No Y12 diameter hooks, are preferably included in the voussoir formation, and then part covered by the top layer 22.

Thus the arch ring unit 10 has a layer of fiber reinforced concrete, for example 1% reinforced polypropylene fiber of 40 $N/mm^2$ strength, along the top 40 mm, which layer also includes a non-corrosive reinforcement grid, such as geogrid or paragrid, grade 100/25 or 35/35, and a plurality of lifting hooks 24 therealong.

Once cured, the arch ring unit 10 can be lifted using the hooks 24, and easily transported to its relevant site. The linear shape of the arch ring unit 10 may allow the transporter to carry more than one arch ring unit 10 to a relevant site. Moreover, transportation of a linear concrete unit 10 is a relatively simple exercise on a flat-bed trailer, etc.

Figure 3:
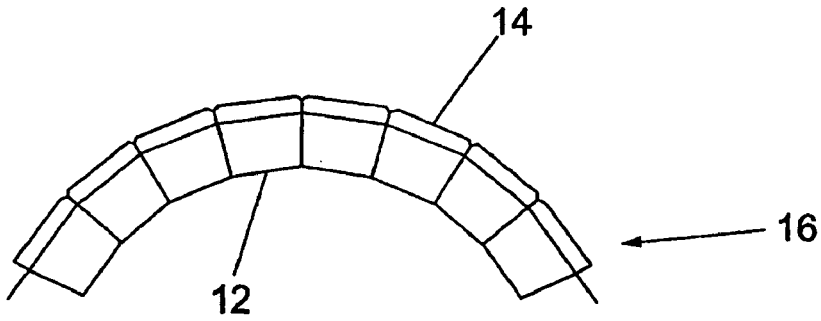
FIG. 3 is a side view of the arch ring unit of FIG. 2 when arched.

When required, the arch ring unit 10 is arched by lifting at appropriate lifting points along the ring unit 10, which points will depend on the weight, size and number of voussoirs 12. The lifting may also sit the ring unit 10 in place. As shown in FIG. 3, this forms an archway 16.

Figure 4:
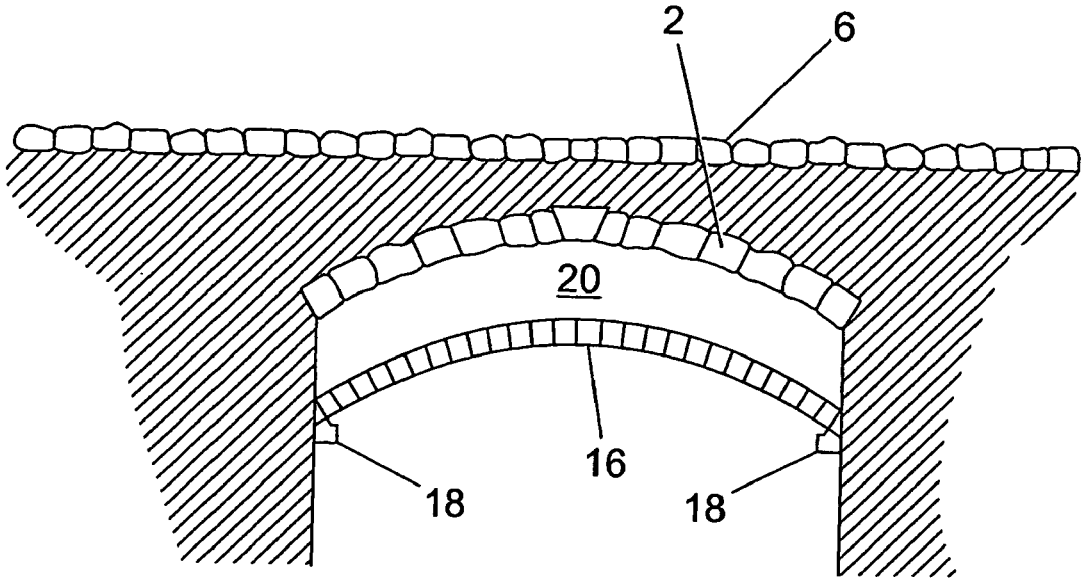
FIG. 4 is a side view of the arch of FIG. 1 with the arch ring unit in FIG. 2 located therewith.
Figure 5:
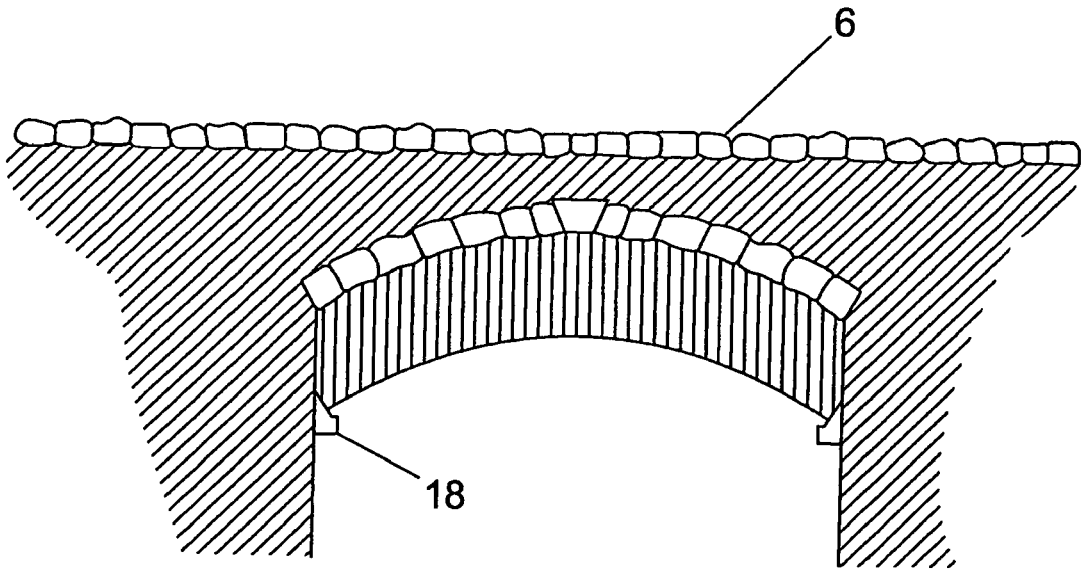
FIG. 5 is the completed new archway of FIG. 4.

FIG. 4 shows the location of an archway 16 of the present invention onto two prepared springings 18 located underneath the existing arch 2 of FIG. 1. The resulting gap 20 can be filled with grout or foam concrete as well known in the art, to create the completed arch as shown in FIG. 5.

Figure 6:
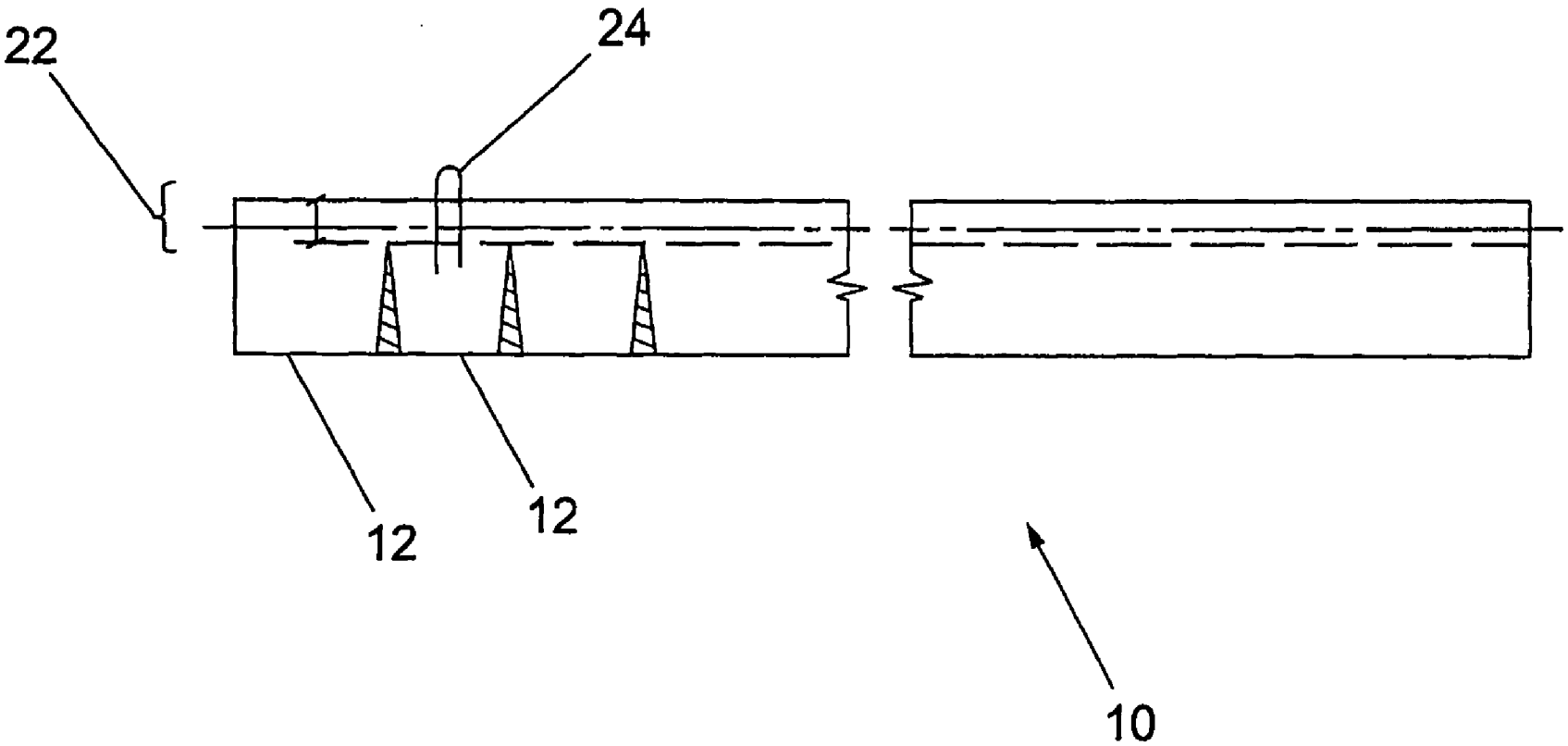
FIG. 6 is a detailed side view of the unit in FIG. 2.
Figure 7:
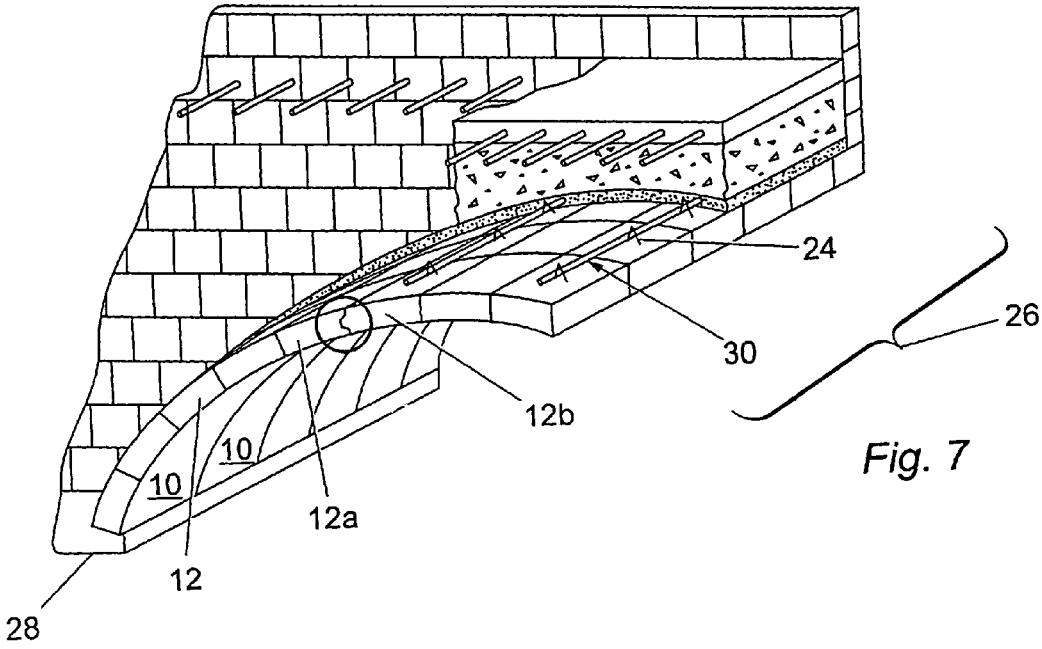
FIG. 7 is a part cross-sectional perspective view of part of a bridge using the present invention.

FIG. 7 shows a number of arch ring units 10 of FIG. 6 aligned together to form an overall archway 26. The ends of the arch ring units 10 are located on a baseblock 28. Each voussoir 12 of each unit 10 includes a lifting hook 24. Arrangement of these hooks 24 at a 45° angle to the longitudinal axis of the unit 10 allows the hooks 24 to be used in two ways. First, it allows a single bar to be inserted through all hooks of one unit 10 to allow their simultaneous and aligned lifting in a flat form for transportation to a site. Second, it allows tie rods 30 to be inserted latitudinally across the hooks 24 of aligned units 10 (as shown in FIG. 7), in order to increase the connection and the stability of the combined units 10.

Figure 7A:
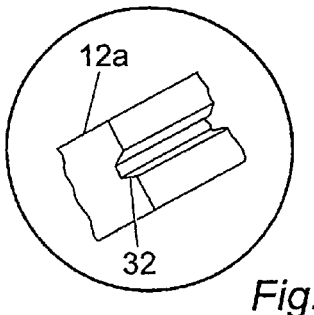
FIG. 7*a* being a detail enlargement of part of FIG. 7.

FIG. 7*a* shows detail of the side of one voussoir portion 12*a*, having a female groove 32 therealong. This matches a corresponding male edge along the neighboring voussoir portion 12*b*. The female groove 32 and male edge can easily be formed in the casting process. Their interlocking forms a shear key when the arch unit 10 is formed, and increases the overall rigidity of the unit 10. The shear key particularly serves to reduce the risk of shear between the voussoir portions 12. Shear keys could be formed between all the voussoir portions 12.

As shown in FIG. 7, once the units 10 are in place, a layer of concrete approximately 50 mm thick can be added thereover to provide a single overlayer. On top of this can be added general filling such as compacted stone, before the beginnings of a road surface such as a concrete slab with starter bars.

The overall span of the archway shown in FIG. 7 is approximately 4 meters. This has been formed by a number of simple units 10 rather than pre-cast arched concrete slabs.

The present invention provides a simple yet effective process and unit for forming an archway. With ease of production, shaping and transportation, making new archways or repair of existing bridge archways is significantly faster and cheaper, minimizing disruption and delay to traffic.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A flat-formed arch ring unit comprising a linear array of voussoir portions connected along their upper edges, wherein the unit includes a plurality of lifting points along its length, the unit including lifting hooks at said lifting points whereby the unit is liftable and transportable by said lifting hooks in its linear shape.

2. The arch ring unit as claimed in claim 1, wherein the unit includes at least one hook per voussoir portion.

3. The arch ring unit as claimed in claim 1 or 2, wherein at least some of the lifting hooks are aligned.

4. The arch ring unit as claimed claim 3, wherein the arch ring unit is liftable using a single bar or rod or an aligned set of bars or rods in conjunction with a plurality of said aligned lifting hooks.

5. The arch ring unit as claimed in claim 1, wherein the ring unit includes reinforcement within the ring unit, the reinforcement is at least substantially within an area of connection of the voussoir portions.

6. The arch ring unit as claimed in claim 5, wherein the reinforcement is formed from a plastic lattice grid.

7. The arch ring unit as claimed in claim 5 or 6, wherein the reinforcement assists connection of the voussoir portions during handling and transportation of the ring unit.

8. The arch ring unit as claimed in claim 1, wherein the ring unit has an upper continuous band along the top of or as part of an upper portion of the voussoir portions.

9. The arch ring unit as claimed in claim 8, wherein the upper band has a different material constituency then that of a remaining part of the arch ring unit.

10. The arch ring unit as claimed in claim 8 or 9, wherein the upper band comprises fiber reinforced concrete.

11. The arch ring unit as claimed in claim 1, wherein at least some of the voussoir portions are formed with corresponding male and female parts on their opposing sides.

12. A two part process for forming a flat-formed arch ring unit as described in claim 1, comprising the steps of:

separately forming each voussoir portion;

aligning the voussoir portions such that their wider top faces at least substantially meet; and forming a connection layer across an upper portion of the voussoir portions.

13. The process as claimed in claim 12, wherein the connection layer is separately cast across the voussoir portions.

14. A method of forming an archway between at least two foundation blocks, comprising lifting at least one flat formed arch ring unit as described in claim 1 using one or more of said plurality of lifting hooks to form the arch ring into an arch, and locating the arched ring unit between the at least two foundation blocks.

15. The method as claimed in claim 14, wherein the archway has a span in a range of about 3 to 8 meters.

* * * * *